US005619094A

United States Patent [19]

Vriens

[11] Patent Number: 5,619,094

[45] Date of Patent: Apr. 8, 1997

[54] COLOR CATHODE RAY TUBE AND DISPLAY DEVICE WITH REDUCED MOIRE

[75] Inventor: Leendert Vriens, Eindhoven, Netherlands

[73] Assignee: U.S. Philips Corporation, New York, N.Y.

[21] Appl. No.: 534,213

[22] Filed: Sep. 26, 1995

[30] Foreign Application Priority Data

Oct. 5, 1994 [NL] Netherlands ..... 94202881

[51] Int. Cl.[6] ..... H01J 29/07

[52] U.S. Cl. ..... 313/402; 313/408

[58] Field of Search ..... 313/402, 403, 313/404, 405, 406, 407, 408, 461

[56] References Cited

U.S. PATENT DOCUMENTS 5,055,736 10/1991 Yun et al. ..... 313/402

5,378,959 1/1995 Mancini ..... 313/402

*Primary Examiner*—Sandra L. O'Shea
*Assistant Examiner*—Vip Patel
*Attorney, Agent, or Firm*—John C. Fox

[57] ABSTRACT

By selecting the number of apertures in the shadow mask of a color cathode ray tube system to be such that the $s/a_v$ ratio, where s is the scan pitch for the entire frame and $a_v$ is the vertical mask pitch, is between 5.8/8 and 6.4/8 ($5.8/8 \leqq s/a_v \leqq 6.4/8$) or between 9.4/8 and 10.6/8 where the lines are progressively scanned or, where the lines are scanned in an interlace mode with a frequency higher than 70 Hz, the $s/a_v$ ratio is between 5.8/8 and 6.4/8 ($5.8/8 \leqq s/a_v \leqq 6.4/8$) or between 9.4/8 and 10.6/8, a cathode ray tube system is provided with a reduced occurence of disturbing Moiré effects.

4 Claims, 3 Drawing Sheets

COLOR CATHODE RAY TUBE AND DISPLAY DEVICE WITH REDUCED MOIRE

BACKGROUND OF THE INVENTION

The invention relates to a colour cathode ray tube system comprising a colour cathode ray tube comprising an electron gun for generating at least one electron beam, a colour selection electrode having rows of apertures, a display screen and means for deflecting the electron beam across the colour selection electrode in a line deflection direction transverse to the row of apertures.

Such display devices are known. They are used, inter alia, in television receivers.

A disturbing effect which may occur in such display devices is the so-called Moiré effect. This effect causes light and dark lines or lines of a deviating colour in the image.

In operation, lines are written on the display screen in the line deflection direction by the electron beam(s). The number of lines written on the display screen (the so-called number of active lines) is system-dependent. In the PAL and SECAM systems approximately 537 lines are written on the display screen, (in these systems the signal comprises 625 lines; approximately 50 of said lines are used for coded information; of the remaining 575 lines approximately 7% is scanned beside the display screen, the so-called "overscan"; thus, the overall number of active lines is approximately (625–50)/1.07=537). In the NTSC system approximately 452 active lines are written (the NTSC signal comprises 525 lines). In operation, a colour cathode ray tube preferably does not exhibit disturbing Moiré effects.

OBJECTS AND SUMMARY OF THE INVENTION

It is an object of the invention to provide a colour cathode ray tube which can be used in several systems and in which no disturbing Moiré effect occurs.

To this end, the colour cathode ray tube in accordance with the invention is characterized in that the lines are scanned in a progressive manner and in that the so-called $s/a_v$ ratio, where s is the scan pitch for the entire frame and $a_v$ is the vertical mask pitch, is between 5.8/8 and 6.4/8 ($5.8/8 \leqq s/a_v \leqq 6.4/8$) or between 9.4/8 and 10.6/8 or that the lines are scanned in an interlace mode with a frequency higher than 70 Hz where the $s/a_v$ ratio is between 5.8/8 and 6.4/8 ($5.8/8 \leqq s/a_v \leqq 6.4/8$) or between 9.4/8 and 10.6/8.

BRIEF DESCRIPTION OF THE DRAWINGS

These and further aspects of the invention will be explained in greater detail by means of an example and with reference to the accompanying drawing, in which.

Figure 1:
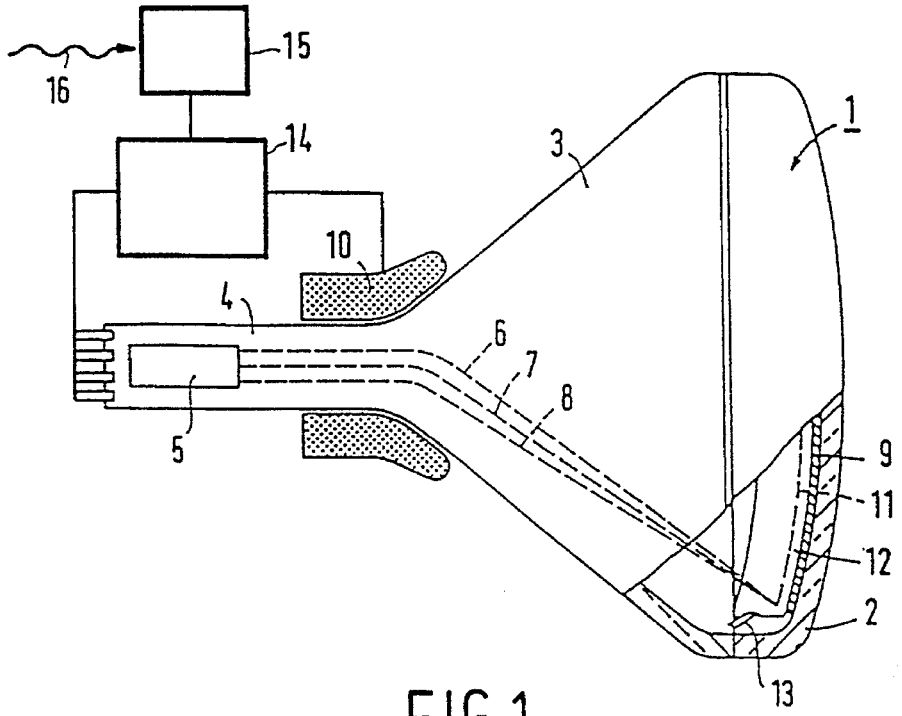
FIG. 1 is a colour cathode my tube.

The Figures are diagrammatic.

In the Figures, like reference numerals refer to like parts.

DESCRIPTION OF THE PREFERRED EMBODIMENT

FIG. 1 is a partly perspective view of a cathode ray tube 1. Said cathode ray tube 1 comprises an evacuated envelope 3 having a display window 2, and a neck 4. In the neck there is provided an electron gun 5 for generating, in this example, three electron beams 6, 7, and 8. On the inside of the display window 2 there is provided a luminescent display screen 9 which, in this example, comprises phosphor elements luminescing in red, green and blue. On their way to the screen 9, said electron beams 6, 7, and 8 are deflected across the screen 9 by means of a deflection unit 10, which is located at the junction between the neck and the cone, and pass through the colour selection electrode, in this example the shadow mask 11 which comprises a thin plate having apertures 12. The electron beams 6, 7, and 8 pass through said apertures 12 at a small angle with respect to each other and each electron beam impinges on phosphor elements of only one colour. Said Figure also diagrammatically shows the drive mechanism 14 of the electron gun and the deflection unit as well as the receiving means 15 for receiving a signal 16.

Figure 2:
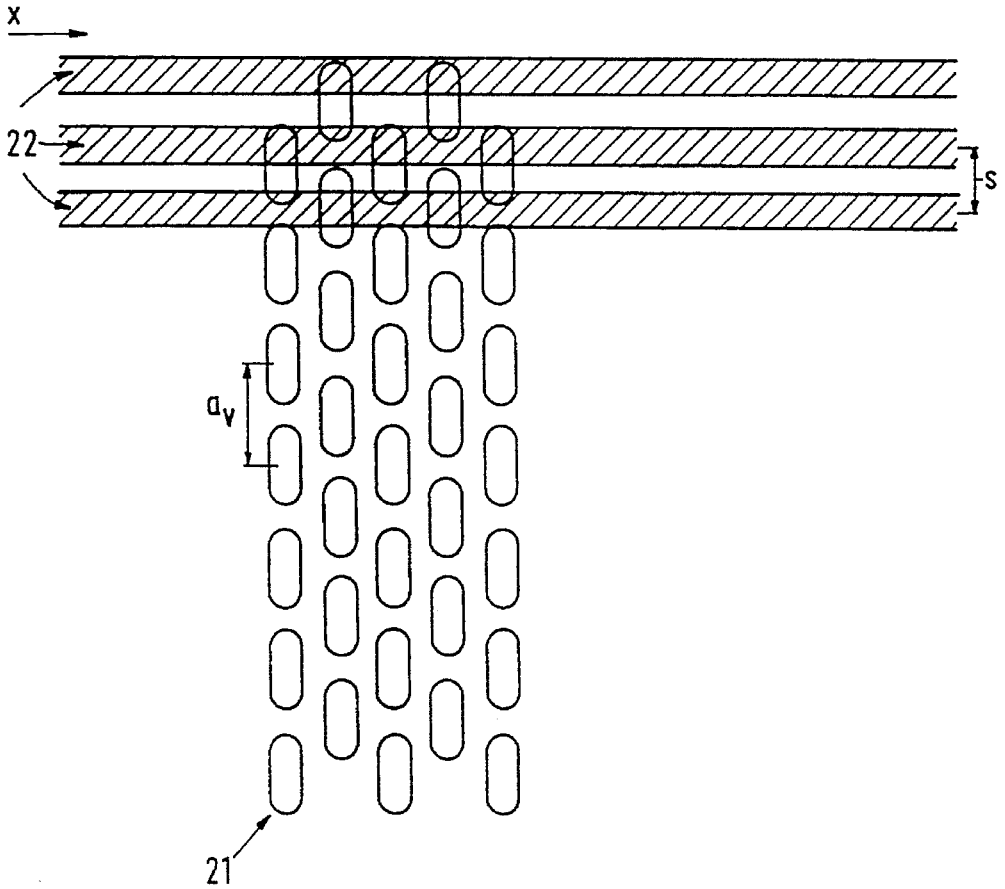
FIG. 2 is a detail of a colour selection electrode.

FIG. 2 is a top view of a detail of a colour selection electrode. Said colour selection electrode comprises a number of rows of apertures 21. Said rows extend transversely to the line deflection direction x. In successive rows the apertures are offset relative to each other in a direction transverse to the line deflection direction. Scanning lines 22 are also shown. Said lines diagrammatically show where the electron beam(s) is (are) incident on the shadow mask.

In the case of the so-called PAL and SECAM system, which is used in Europe, Asia, Africa and parts of South-America, the number of lines which are incident on the shadow mask and which impinges on the display screen after passing through the apertures of the shadow mask is approximately 537. The number of active lines of the NTSC system is approximately 452. In Japan the MUSE system is used wherein the number of active lines is approximately (1125–90)/1.07=937. In FIG. 2 the scanning-line pitch s is shown. This is the distance between the scanning lines. The distance between the apertures (vertical mask pitch) $a_v$ is also shown.

Interference of the pattern of apertures in the colour selection electrode with the scanning-line pattern causes Moiré effects. Moiré effects occur in horizontal directions (in which case horizontal bars are visible in the image displayed) and at oblique angles (oblique bars appear in the image). Combinations thereof, which appear for example in the form of a diamond pattern, are also possible.

The colour cathode ray tube in accordance with the invention is characterized in that the $s/a_v$ ratio (where s is the scan pitch for the entire frame and $a_v$ is the mask pitch) ranges between 5.8/8 and 6.4/8 ($5.8/8 \leqq s/a_v \leqq 6.4/8$) or between 9.4/8 and 10.6/8 where the lines are scanned in a progressive manner or where the lines are scanned in an interlace manner with a frequency of more than 70 Hz.

Hitherto it was known that the $s/a_v$ ratio has an influence on the Moiré effect. It was assumed that Moiré patterns were generated when $s/a_v$ was equal to 2n/8 where n is a whole number and no Moiré patterns were generated when $s/a_v$ were (2n+1)/8. $s/a_v$ ratios were thus chosen to be symmetrical with respect to the "forbidden" values 2n/8. Within the framework of the present invention it has however been realized that the best ratios are not symmetrical with respect to the "forbidden" ratios 2n/8. More in particular it has been realized that the "forbidden" ratio $s/a_v$ of 8/8 corresponds to still-picture moiré with a high amplitude, and thus very disturbing, whereas the "forbidden" ratios $s/a_v$ of 6/8 and 10/8 correspond to moiré with a small amplitude. It had not been recognized before that the differences in Moiré amplitudes is extremely large, under normal operating conditions more than a factor of 10. Moreover for a progressive scan the amplitude of the moiré effects is, in respect of interlace scanning even further reduced to such an extent that the moiré effects for the "forbidden" ratios 6/8 and 10/8 are comparable to or even less than for the ratios 5/8, 7/8 and 9/8. The reason for this effect is that an $s/a_v$ ratio of approximately 5/8 is so relatively close to the stronly forbidden ratio of 4/8 that the disturbing spill-over effects of the forbidden ratio 4/8 at the ratio 5/8 are larger than the disturbing effects at 6/8 properly. The best range of $s/a_v$ ratios lies somewhat closer to 8/8 than to 4/8 thus leading to range of approximately 5.8/8 to 6.4/8.

Likewise it has been found that for progressive scanning the amplitude of the Moiré effects are for $s/a_v$=8/8 much larger than for $s/a_v$=12/8, and for $s/a_v$=12/8 larger than for $s/a_v$=10/8. The difference in amplitude between the Moiré effects is for progressive scanning thus that at approximately the hitherbefore believed "forbidden" ratio of 10/8 the moiré effects are, surprisingly, comparable or even less than at the ratios 9/8 and 11/9. Therefore a display device according to the invention has a $s/a_v$ ratio between 9.4/8 and 0.6/8.

In a progressive scanning mode, as is well known to persons skilled in the art, the lines are scanned progressively. In an interlace scanning mode, the lines are scanned interlaced, i.e. first half of the lines (the even or odd lines) are scanned and thereafter the other lines are scanned.

The Moiré effects are different for interlace and progressive scanning. More in particular for the above cited ratios 6/8 and 10/8 the Moiré patterns are more disturbing for interlace scanning. In effect, for normal scanning speed (i.e. 50–60 Hz) the Moiré effects at said ratios are so large that, and more in particular the effects of the two interlace field together are so large that they are noticable resulting for said ratios in clearly visible worse Moiré effects than at ratios at or around 5/8, 7/8 etc.

However, a major part of this effect is due to the fact that the human vision system, even at scanning speeds of 50–60 Hz, notices the Moiré effects of the two interlaced fields together. At higher scanning speeds (higher than 70 Hz and in particular 100 Hz or higher) the human vision system can no longer distinguish the Moiré effects of the two interlaced fields together. As a consequence for such high scanning speeds the Moiré effects, for interlaced scanning, are comparable in amplitude to the Moiré effects for progressive scanning, and thus $s/a_v$ ratios between 5.8/8 and 6.4/8 ($5.8/8 \leqq s/a_v \leqq 6.4/8$)or between 9.4/8 and 10.6/8 are preferred.

Ratios of between 5.8/8 and 6.4/8 provide display systems with a high luminance because of the relatively large proportion of electrons which pass the apertures in the colour selection electrode.

Ratios of between 9.4/8 and 10.6/8 provide display systems which enable very fine details to be displayed because of the relatively small size of the apertures in the colour selection electrode.

Figure 3A:
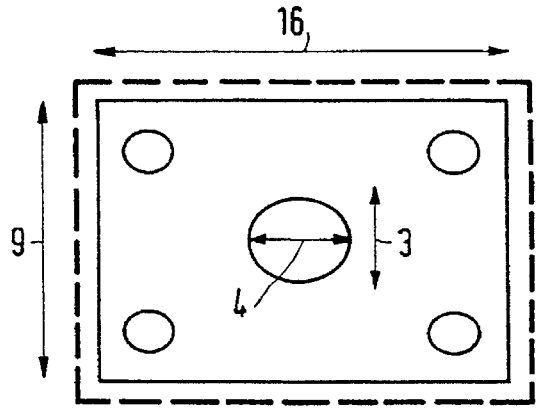
FIGS. 3A to 3E illustrate aspects of the invention relating to the display of 4:3 images on a 16:9 display screen.
Figure 3B:
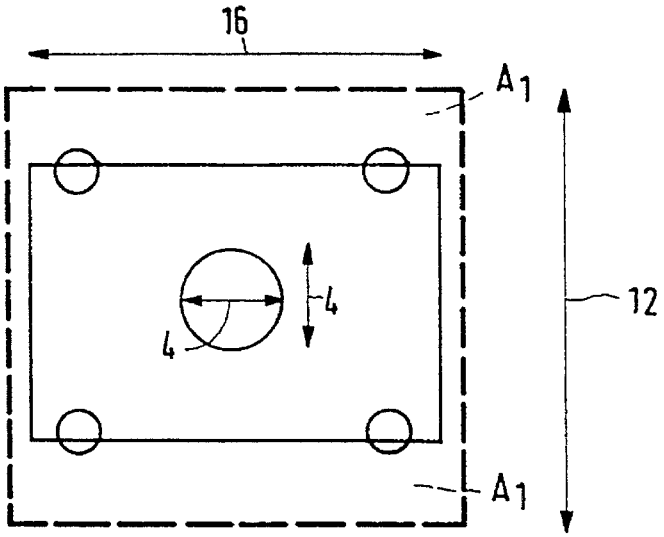
Figure 3C:
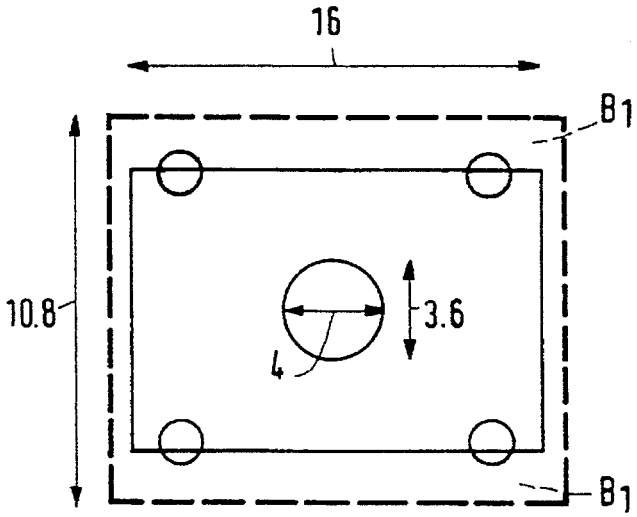
Figure 3D:
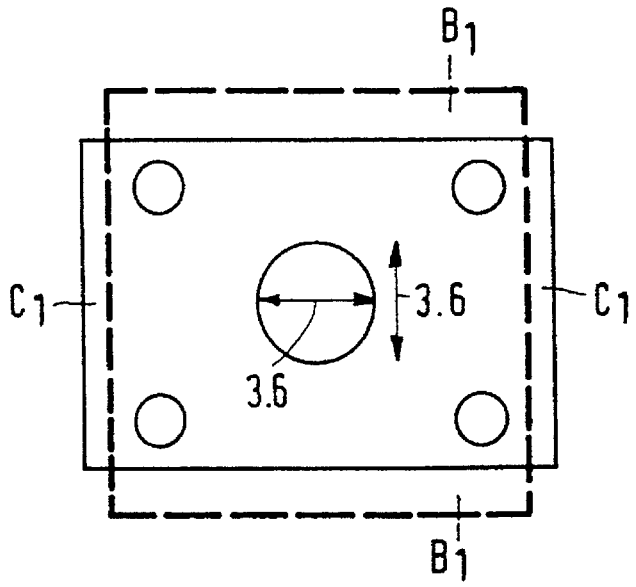
Figure 3E:
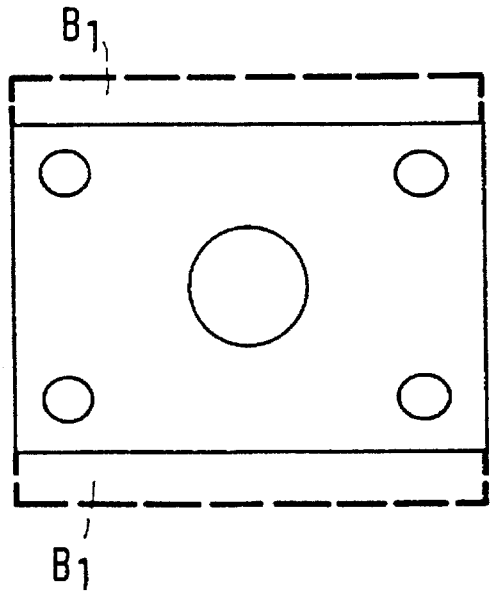

For display devices with a larger aspect ratio (i.e. the aspect ratio being larger than 4:3) and more in particular for display devices in which the aspect ratio is 16:9 a further aspect of the invention is illustrated in FIGS. 3A to 3D. FIG. 3A shows a wide screen display device on which a 4:3 image is displayed. Such an image cannot fill the screen. In order to better fill the screen the display device can be provided with means for expanding the image in the vertical direction. However, if, as hitherbefore usual the image displayed in expanded in the vertical direction by a factor 1.333 the $s/a_v$ ratio also changes by a factor 4:3. This means that for a system having a $s/a_v$ ratio ranging between 5.8/8 and 6.4/8 the $s/a_v$ ratio changes due to the expansion from the range 5.8/8–6.4/8 to the range 7.7/8 to 8.5/8. For such $s/a_v$ ratios an appreciable amount of Moiré effects occur. The Moiré effects can be substantially reduced by expanding the image to a lesser extent such that the resulting $s/a_v$ ratio ranges between 6.8/8 and 7.4/8, i.e by a factor of approximately 1.15 to 1.2 FIGS. 3A to 3D illustrate aspects of the invention relating to the display of 4:3 images on a 16:9 screen. FIG. 3A shows for a PAL system the dimensions of an image broadcast in the 4:3 format, when displayed on a 16:9 screen. The screen is indicated by full lines, the image displayed on the screen by dotted lines. Since there is usually an overscan the dotted lines extend slightly beyond the full lines. For simplicity it is assumed that the original, undistorted image comprised five circles, one in the centre of the image and one at each corner. As can be seen the image is portrayed in a distorted manner, where the circles have become ovals, the ratio of height and width of the ovals being 3:4. The width is in this figure indicated by 4 and the height by 3. In subsequent figures the width and height of the displayed images will also be indicted. This distortion of the image displayed on the screen is in itself a known problem. FIG. 3B shows the conventional manner of dealing with this problem. The image is expanded in the vertical direction (by means of increasing the line spacing s) by a factor of 1.333. FIG. 3C shows an aspect of the invention. In this figure the image is also expanded in the vertical direction by a smaller factor. The decreased expansion of the image in the vertical direction has several advantages. The number of lines (and thus the extent in which the image is not displayed) that is lost is less, since whereas in the conventional system 33% of the originally displayed image is lost, in a device according to the invention only 15–20% of said image is lost. In FIGS. 3B and 3C the parts of the image that are lost are indicated by A1 and B1. Clearly it can be seen that the areas B in FIG. 3C are smaller than the areas A in FIG. 3B. Furthermore, and most importantly, the $s/a_v$ ratio has decreased from approximately 8/8 in FIG. 3B to approximately 7/8. This has the advantage effect that Moiré effects are strongly reduced. A further advantageous effect is that the ability to display fine details is improved. As is shown in FIG. 3C the dimensions of the displayed image are 4 (width): 3.6 (height). Although this is a clear improvement on the situation as shown in FIG. 3A further improvements are possible. One possible further improvement is shown in FIG. 3D. In this figure the image is compressed in the horizontal direction by a factor of 0.9, resulting in dimensions of 3.6 (width):3.6 (height). If the originally displayed picture would have fitted perfectly on the screen such a reduction would have resulted in the occurrence of two black bars (indicated by C1 in FIG. 3D) on the left and fight side of the displayed image, each bar having a horizontal dimension of approximately 5% of the horizontal dimension of the display screen. However in reality images are displayed with a so-called overscan of 7%. Therefore the bars are much smaller, only approximately 1,5% (1 cm) at each side. Such bars are barely visible. Of course it is also possible to compress the image in the horizontal direction by a smaller amount (for instance by a factor of 0.95) in which case bars are no longer visible, but the displayed image will be somewhat distorted and have a width:height ratio of 3.8:3.6. For most images such a distortion will however be hardly visible. An alternative is shown in FIG. 3E. In this figure the horizontal dimension of the image displayed in compressed in the centre of the screen resulting in a perfect circle. At the edges of the screen the horizontal dimension is however somewhat expanded. This result in a perfect image at the centre but a somewhat distorted image at the edges of the screen, while the image completely fills the screen. In this embodiment the image therefore is subjected to an increase in the $s/a_v$ ratio by approximately 1.15 to 1.2) combined with a panoramic distortion in the horizontal direction. Thus in this embodiment the display system operates in the normal mode (i.e. when aspect ratio of the image recieved corresponds to the aspect ratio of the display screen) such that the $s/a_v$ ratio ranges between 5.8/8 and 6.4/8, and in the expanded mode (when the aspect ratio of the received image differs from the aspect ratio of the display screen) the $s/a_v$ ratio ranges between 6.8/8 and 7.4/8.

I claim:

1. A colour cathode my tube system comprising a colour cathode ray tube comprising an electron gun for generating at least one electron beam, a colour selection electrode having rows of apertures, a display screen and means for deflecting the electron beam across the colour selection electrode in a line deflection direction transverse to the row of apertures, characterized in that, the lines are scanned in a progressive manner and in that the so-called $s/a_v$ ratio, where s is the scan pitch for the entire frame and $a_v$ is the vertical mask pitch, is between 5.8/8 and 6.4/8 ($5.8/8 \leqq s/a_v \leqq 6.4/8$) or between 9.4/8 and 10.6/8.

2. A colour cathode ray tube system comprising a colour cathode ray tube comprising an electron gun for generating at least one electron beam, a colour selection electrode having rows of apertures, a display screen and means for deflecting the electron beam across the colour selection electrode in a line deflection direction transverse to the row of apertures, characterized in that, the lines are scanned in an interlace mode with a frequency higher than 70 Hz where the $s/a_v$ ratio, where s is the scan pitch for the entire frame and $a_v$ is the vertical mask pitch, is between 5.8/8 and 6.4/8 ($5.8/8 < s/a_v < 6.4/8$) or between 9.4/8 and 10.6/8.

3. A display device as claimed in claim 1, characterized in that the the $s/a_v$ ratio ranges between 5.8/8 and 6.4/8 and the colour cathode ray tube comprises a display screen with an aspect ratio larger than 4:3 and the display device comprises means to expand in the field deflection direction the image displayed on the screen in such manner that the $s/a_v$ ratio of the image displayed in the expanded mode ranges between 6.8/8 and 7.4/8.

4. A display device as claimed in claim 2, characterized in that the $s/a_v$ ratio ranges between 5.8/8 and 6.4/8 and the colour cathode ray tube comprises a display screen with an aspect ratio larger than 4:3 and the display device comprises means to expand in the field deflection direction the image displayed on the screen in such manner that the $s/a_v$ ratio of the image displayed in the expanded mode ranges between 6.8/8 and 7.4/8.

* * * * *